US009015038B2

(12) United States Patent
Vaillancourt et al.

(10) Patent No.: US 9,015,038 B2
(45) Date of Patent: Apr. 21, 2015

(54) CODING GENERIC AUDIO SIGNALS AT LOW BITRATES AND LOW DELAY

(75) Inventors: Tommy Vaillancourt, Sherbrooke (CA); Milan Jelinek, Sherbrooke (CA)

(73) Assignee: VoiceAge Corporation, Town of Mount Royal, Quebec (CA)

( * ) Notice: Subject to any disclaimer, the term of this patent is extended or adjusted under 35 U.S.C. 154(b) by 848 days.

(21) Appl. No.: 13/280,707

(22) Filed: Oct. 25, 2011

(65) Prior Publication Data

US 2012/0101813 A1 Apr. 26, 2012

Related U.S. Application Data

(60) Provisional application No. 61/406,379, filed on Oct. 25, 2010.

(51) Int. Cl.

| | |
|---|---|
| ***G10L 11/04*** | (2006.01) |
| ***G10L 19/20*** | (2013.01) |
| *G10L 19/02* | (2013.01) |
| *G10L 19/08* | (2013.01) |

(52) U.S. Cl.
CPC ..... *G10L 19/20* (2013.01); *G10L 19/02* (2013.01); *G10L 19/08* (2013.01)

(58) Field of Classification Search
USPC ..... 704/203, 205, 219, 223, 500–504, 704/229–230, 206, 221, 227
See application file for complete search history.

(56) References Cited

U.S. PATENT DOCUMENTS

| | | | | |
|---|---|---|---|---|
| 2007/0225971 | A1* | 9/2007 | Bessette | 704/203 |
| 2007/0299656 | A1* | 12/2007 | Son et al. | 704/205 |
| 2009/0240491 | A1* | 9/2009 | Reznik | 704/219 |

FOREIGN PATENT DOCUMENTS

| | | | |
|---|---|---|---|
| CN | 1527282 | A | 9/2004 |
| EP | 2146344 | A1 | 1/2010 |
| WO | 9960561 | | 11/1999 |

OTHER PUBLICATIONS

Griffin et al., "Multiband Excitation Vocoder," IEEE Transactaions on Acoustics, Speech, and Signal Processing, 36 (8):1223-1235, Aug. 1988.

Yeldener et al., "A High Quality Speech Coding Algorithm Suitable for Future INMARSAT Systems," Proceedings of the 7th European Signal Processing Conference (EUSIPCO-94), Sep. 1994, pp. 407-410.

(Continued)

*Primary Examiner* — Huyen Vo
(74) *Attorney, Agent, or Firm* — K&L Gates LLP

(57) ABSTRACT

A mixed time-domain/frequency-domain coding device and method for coding an input sound signal, wherein a time-domain excitation contribution is calculated in response to the input sound signal. A cut-off frequency for the time-domain excitation contribution is also calculated in response to the input sound signal, and a frequency extent of the time-domain excitation contribution is adjusted in relation to this cut-off frequency. Following calculation of a frequency-domain excitation contribution in response to the input sound signal, the adjusted time-domain excitation contribution and the frequency-domain excitation contribution are added to form a mixed time-domain/frequency-domain excitation constituting a coded version of the input sound signal. In the calculation of the time-domain excitation contribution, the input sound signal may be processed in successive frames of the input sound signal and a number of sub-frames to be used in a current frame may be calculated.

58 Claims, 6 Drawing Sheets

(56) References Cited

OTHER PUBLICATIONS

Yeldener et al., "A Mixed Sinusoidally Excited Linear Prediction Coder at 4 KB/S and Below," Proceedings of the 1998 International Conference on Acoustics, Speech and Signal Processing, 2:589-592, 1998.
Yeldener et al., "Multiband Linear Predictive Speech Coding at Very Low Bit Rates," IEEE Proceedings—Vision, Image and Signal Processing, 141(5):289-296, Oct. 1994.
International Search Report and Written Opinion for International Application PCT/CA2011/001182, mailed Jan. 6, 2012, 13 pages.
Recommendation ITU-T G.718, "Frame Error Robust Narrow-Band and Wideband Embedded Variable Bit-Rate Coding of Speech and Audio from 8-32 kbit/s," International Telecommunication Union, Jun. 2008, 259 pgs.
3GPP TS 26.190 V6.1.1, "3rd Generation Partnership Project; Technical Specification Group Services and System Aspects; Speech codec speech processing functions; Adaptive Multi-Rate—Wideband (AMR-WB) speech codec; Transcoding functions (Release 6)," Global System for Mobile Communications, Jul. 2005, 53 pgs.
Eksler et al., "Transition mode coding for source controlled CELP codecs," IEEE Proceedings of International Conference on Acoustics, Speech and Signal Processing, Mar.-Apr. 2008, pp. 4001-4004.
Mittal et al., "Low Complexity Factorial Pulse Coding of MDCT Coefficients Using Approximation of Combinatorial Functions," IEEE Proceedings on Acoustic, Speech and Signals Processing, vol. 1, Apr. 2007, pp. 289-292.
Vaillancourt et al., "Inter-tone noise reduction in a low bit rate CELP decoder," Proc. IEEE ICASSP, Taipei, Taiwan, Apr. 2009, pp. 4113-4116.

* cited by examiner

CODING GENERIC AUDIO SIGNALS AT LOW BITRATES AND LOW DELAY

RELATED APPLICATIONS

This application claims priority to and the benefit of U.S. Provisional Application No. 61/406,379, filed on Oct. 25, 2010, the entire contents of which are incorporated by reference herein.

FIELD

The present disclosure relates to mixed time-domain/frequency-domain coding devices and methods for coding an input sound signal, and to corresponding encoder and decoder using these mixed time-domain/frequency-domain coding devices and methods.

BACKGROUND

A state-of-the-art conversational codec can represent with a very good quality a clean speech signal with a bit rate of around 8 kbps and approach transparency at a bit rate of 16 kbps. However, at bitrates below 16 kbps, low processing delay conversational codecs, most often coding the input speech signal in time-domain, are not suitable for generic audio signals, like music and reverberant speech. To overcome this drawback, switched codecs have been introduced, basically using the time-domain approach for coding speech-dominated input signals and a frequency-domain approach for coding generic audio signals. However, such switched solutions typically require longer processing delay, needed both for speech-music classification and for transform to the frequency domain.

To overcome the above drawback, a more unified time-domain and frequency-domain model is proposed.

SUMMARY OF THE INVENTION

Figure 1:
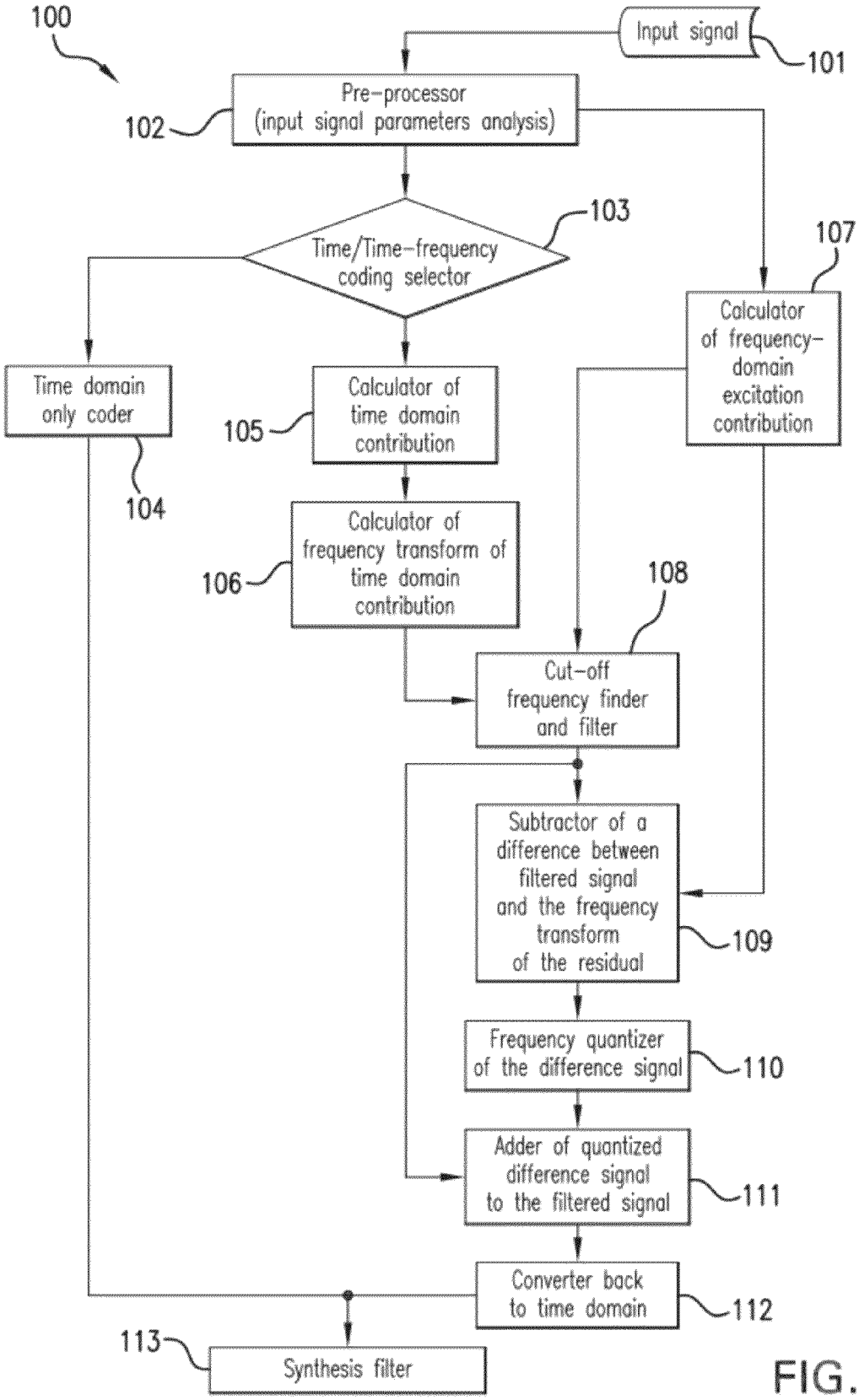
FIG. 1 is a schematic block diagram illustrating an overview of an enhanced CELP (Code-Excited Linear Prediction) encoder, for example an ACELP (Algebraic Code-Excited Linear Prediction) encoder.

According to one embodiment, the present disclosure relates to a mixed time-domain/frequency-domain coding device for coding an input sound signal, comprising: a calculator of a time-domain excitation contribution in response to the input sound signal; a calculator of a cut-off frequency for the time-domain excitation contribution in response to the input sound signal; a filter responsive to the cut-off frequency for adjusting a frequency extent of the time-domain excitation contribution; a calculator of a frequency-domain excitation contribution in response to the input sound signal; and an adder of the filtered time-domain excitation contribution and the frequency-domain excitation contribution to form a mixed time-domain/frequency-domain excitation constituting a coded version of the input sound signal.

According to a second embodiment, the present disclosure relates to an encoder using a time-domain and frequency-domain model, comprising: a classifier of an input sound signal as speech or non-speech; a time-domain only coder; the above described mixed time-domain/frequency-domain coding device; and a selector of one of the time-domain only coder and the mixed time-domain/frequency-domain coding device for coding the input sound signal depending on the classification of the input sound signal.

According to another embodiment, the present disclosure provides a mixed time-domain/frequency-domain coding device for coding an input sound signal, comprising: a calculator of a time-domain excitation contribution in response to the input sound signal, wherein the calculator of time-domain excitation contribution processes the input sound signal in successive frames of the input sound signal and comprises a calculator of a number of sub-frames to be used in a current frame of the input sound signal, wherein the calculator of time-domain excitation contribution uses in the current frame the number of sub-frames determined by the sub-frame number calculator for the current frame; a calculator of a frequency-domain excitation contribution in response to the input sound signal; and an adder of the time-domain excitation contribution and the frequency-domain excitation contribution to form a mixed time-domain/frequency-domain excitation constituting a coded version of the input sound signal.

According to a fourth embodiment, the present disclosure relates to a decoder for decoding a sound signal coded using one of the mixed time-domain/frequency-domain coding devices as described above, comprising: a converter of the mixed time-domain/frequency-domain excitation in time-domain; and a synthesis filter for synthesizing the sound signal in response to the mixed time-domain/frequency-domain excitation converted in time-domain.

According to a fifth embodiment, the present disclosure is concerned with a mixed time-domain/frequency-domain coding method for coding an input sound signal, comprising: calculating a time-domain excitation contribution in response to the input sound signal; calculating a cut-off frequency for the time-domain excitation contribution in response to the input sound signal; in response to the cut-off frequency, adjusting a frequency extent of the time-domain excitation contribution; calculating a frequency-domain excitation contribution in response to the input sound signal; and adding the adjusted time-domain excitation contribution and the frequency-domain excitation contribution to form a mixed time-domain/frequency-domain excitation constituting a coded version of the input sound signal.

According to a further embodiment, these is described a method of encoding using a time-domain and frequency-domain model, comprising: classifying an input sound signal as speech or non-speech; providing a time-domain only coding method; providing the above described mixed time-domain/frequency-domain coding method, and selecting one of the time-domain only coding method and the mixed time-domain/frequency-domain coding method for coding the input sound signal depending on the classification of the input sound signal.

According to a seventh embodiment, the present disclosure relates to a mixed time-domain/frequency-domain coding method for coding an input sound signal, comprising: calculating a time-domain excitation contribution in response to the input sound signal, wherein calculating the time-domain excitation contribution comprises processing the input sound signal in successive frames of the input sound signal and calculating a number of sub-frames to be used in a current frame of the input sound signal, wherein calculating the time-domain excitation contribution also comprises using in the current frame the number of sub-frames calculated for the current frame;

calculating a frequency-domain excitation contribution in response to the input sound signal; and adding the time-domain excitation contribution and the frequency-domain excitation contribution to form a mixed time-domain/frequency-domain excitation constituting a coded version of the input sound signal.

According to a still further embodiment, these is described a method of decoding a sound signal coded using one of the mixed time-domain/frequency-domain coding methods as described above, comprising: converting the mixed time-domain/frequency-domain excitation in time-domain; and synthesizing the sound signal through a synthesis filter in response to the mixed time-domain/frequency-domain excitation converted in time-domain.

The foregoing and other features will become more apparent upon reading of the following non restrictive description of an illustrative embodiment of the proposed time-domain and frequency-domain model, given by way of example only with reference to the accompanying drawings.

DETAILED DESCRIPTION

The proposed more unified time-domain and frequency-domain model is able to improve the synthesis quality for generic audio signals such as, for example, music and/or reverberant speech, without increasing the processing delay and the bitrate. This model operates for example in a Linear Prediction (LP) residual domain where the available bits are dynamically allocated among an adaptive codebook, one or more fixed codebooks (for example an algebraic codebook, a Gaussian codebook, etc.), and a frequency-domain coding mode, depending upon the characteristics of the input signal.

To achieve a low processing delay low bit rate conversational codec that improves the synthesis quality of generic audio signals like music and/or reverberant speech, the frequency-domain coding mode may be integrated as close as possible to the CELP (Code-Excited Linear Prediction) time-domain coding mode. For that purpose, the frequency-domain coding mode uses, for example, a frequency transform performed in the LP residual domain. This allows switching nearly without artifact from one frame, for example a 20 ms frame, to another. Also, the integration of the two (2) coding modes is sufficiently close to allow dynamic reallocation of the hit budget to another coding mode if it is determined that the current coding mode is not efficient enough.

One feature of the proposed more unified time-domain and frequency-domain model is the variable time support of the time-domain component, which varies from quarter frame to a complete frame on a frame by frame basis, and will be called sub-frame. As an illustrative example, a frame represents 20 ms of input signal. This corresponds to 320 samples if the inner sampling frequency of the codec is 16 kHz or to 256 samples per frame if the inner sampling frequency of the codec is 12.8 kHz. Then a quarter of a frame (the sub-frame) represents 64 or 80 samples depending on the inner sampling frequency of the codec. In the following illustrative embodiment the inner sampling frequency of the codec is 12.8 kHz giving a frame length of 256 samples. The variable time support makes it possible to capture major temporal events with a minimum bitrate to create a basic time-domain excitation contribution. At very low bit rate, the time support is usually the entire frame. In that case, the time-domain contribution to the excitation signal is composed only of the adaptive codebook, and the corresponding pitch information with the corresponding gain are transmitted once per frame. When more bitrate is available, it is possible to capture more temporal events by shortening the time support (and increasing the bitrate allocated to the time-domain coding mode). Eventually, when the time support is sufficiently short (down to quarter a frame), and the available bitrate is sufficiently high, the time-domain contribution may include the adaptive codebook contribution, a fixed-codebook contribution, or both, with the corresponding gains. The parameters describing the codebook indices and the gains are then transmitted for each sub-frame.

At low bit rate, conversational codecs are not capable of coding properly higher frequencies. This causes an important degradation of the synthesis quality when the input signal includes music and/or reverberant speech. To solve this issue, a feature is added to compute the efficiency of the time-domain excitation contribution. In some cases, whatever the input bitrate and the time frame support are, the time-domain excitation contribution is not valuable. In those cases, all the bits are reallocated to the next step of frequency-domain coding. But most of the time, the time-domain excitation contribution is valuable up only to a certain frequency (the cut-off frequency). In these cases, the time-domain excitation contribution is filtered out above the cut-off frequency. The filtering operation permits to keep valuable information coded with the time-domain excitation contribution and remove the non-valuable information above the cut-off frequency. In an illustrative implementation, the filtering is performed in the frequency domain by setting the frequency bins above a certain frequency to zero.

The variable time support in combination with the variable cut-off frequency makes the bit allocation inside the integrated time-domain and frequency-domain model very dynamic. The bitrate after the quantization of the LP filter can be allocated entirely to the time domain or entirely to the frequency domain or somewhere in between. The bitrate allocation between the time and frequency domains is conducted as a function of the number of sub-frames used for the time-domain contribution, of the available bit budget, and of the cut-off frequency computed.

To create a total excitation which will match more efficiently the input residual, the frequency-domain coding mode is applied. A feature in the present disclosure is that the frequency-domain coding is performed on a vector which contains the difference between a frequency representation (frequency transform) of the input LP residual and a frequency representation (frequency transform) of the filtered time-domain excitation contribution up to the cut-off frequency, and which contains the frequency representation (frequency transform) of the input LP residual itself above that cut-off frequency. A smooth spectrum transition is inserted between both segments just above the cut-off frequency. In other words, the high-frequency part of the frequency representation of the time-domain excitation contribution is first zeroed out. A transition region between the unchanged part of the spectrum and the zeroed part of the spectrum is inserted just above the cut-off frequency to ensure a smooth transition between both parts of the spectrum. This modified spectrum of the time-domain excitation contribution is then subtracted from the frequency representation of the input LP residual. The resulting spectrum thus corresponds to the difference of both spectra below the cut-off frequency, and to the frequency representation of the LP residual above it, with some transition region. The cut-off frequency, as mentioned hereinabove, can vary from one frame to another.

Whatever the frequency quantization method (frequency-domain coding mode) chosen, there is always a possibility of pre-echo especially with long windows. In this technique, the used windows are square windows, so that the extra window length compared to the coded signal is zero (0), i.e. no overlap-add is used. While this corresponds to the best window to reduce any potential pre-echo, some pre-echo may still be audible on temporal attacks. Many techniques exist to solve such pre-echo problem but the present disclosure proposes a simple feature for cancelling this pre-echo problem. This feature is based on a memory-less time-domain coding mode which is derived from the "Transition Mode" of ITU-T Recommendation G.718; Reference [ITU-T Recommendation G.718 "Frame error robust narrow-band and wideband embedded variable bit-rate coding of speech and audio from 8-32 kbit/s", June 2008, section 6.8.1.4 and section 6.8.4.2]. The idea behind this feature is to take advantage of the fact that the proposed more unified time-domain and frequency-domain model is integrated to the LP residual domain, which allows for switching without artifact almost at any time. When a signal is considered as generic audio (music and/or reverberant speech) and when a temporal attack is detected in a frame, then this frame only is encoded with this special memory-less time-domain coding mode. This mode will take care of the temporal attack thus avoiding the pre-echo that could be introduced with the frequency-domain coding of that frame.

In the proposed more unified time-domain and frequency-domain model, the above mentioned adaptive codebook, one or more fixed codebooks (for example an algebraic codebook, a Gaussian codebook, etc.), i.e. the so called time-domain codebooks, and the frequency-domain quantization (frequency-domain coding mode can be seen as a codebook library, and the bits can be distributed among all the available codebooks, or a subset thereof. This means for example that if the input sound signal is a clean speech, all the bits will be allocated to the time-domain coding mode, basically reducing the coding to the legacy CELP scheme. On the other hand, for some music segments, all the bits allocated to encode the input LP residual are sometimes best spent in the frequency domain, for example in a transform-domain.

As indicated in the foregoing description, the temporal support for the time-domain and frequency-domain coding modes does not need to be the same. While the bits spent on the different time-domain quantization methods (adaptive and algebraic codebook searches) are usually distributed on a sub-frame basis (typically a quarter of a frame, or 5 ms of time support), the bits allocated to the frequency-domain coding mode are distributed on a frame basis (typically 20 ms of time support) to improve frequency resolution.

The bit budget allocated to the time-domain CELP coding mode can be also dynamically controlled depending on the input sound signal. In some cases, the bit budget allocated to the time-domain CELP coding mode can be zero, effectively meaning that the entire bit budget is attributed to the frequency-domain coding mode. The choice of working in the LP residual domain both for the time-domain and the frequency-domain approaches has two (2) main benefits. First, this is compatible with the CELP coding mode, proved efficient in speech signals coding. Consequently, no artifact is introduced due to the switching between the two types of coding modes. Second, lower dynamics of the LP residual with respect to the original input sound signal, and its relative flatness, make easier the use of a square window for the frequency transforms thus permitting use of a non-overlapping window.

In a non limitative example where the inner sampling frequency of the codec is 12.8 kHz (meaning 256 samples per frame), similarly as in the ITU-T recommendation G.718, the length of the sub-frames used in the time-domain CELP coding mode can vary from a typical ¼ of the frame length (5 ms) to a half frame (10 ms) or a complete frame length (20 ms). The sub-frame length decision is based on the available bitrate and on an analysis of the input sound signal, particularly the spectral dynamics of this input sound signal. The sub-frame length decision can be performed in a closed loop manner. To save on complexity, it is also possible to base the sub-frame length decision in an open loop manner. The sub-frame length can be changed from frame to frame.

Once the length of the sub-frames is chosen in a particular frame, a standard closed-loop pitch analysis is performed and the first contribution to the excitation signal is selected from the adaptive codebook. Then, depending on the available bit budget and the characteristics of the input sound signal (for example in the case of an input speech signal), a second contribution from one or several fixed codebooks can be added before the transform-domain coding. The resulting excitation will be called the time-domain excitation contribution. On the other hand, at very low bit rates and in case of generic audio, it is often better to skip the fixed codebook stage and use all the remaining bits for the transform-domain coding mode. The transform domain coding mode can be for example a frequency-domain coding mode. As described above, the sub-frame length can be one fourth of the frame, one half of the frame, or one frame long. The fixed-codebook contribution is used only if the sub-frame length is equal to one fourth of the frame length. In case the sub-frame length is decided to be half a frame or the entire frame long, then only the adaptive-codebook contribution is used to represent the time-domain excitation, and all remaining bits are allocated to the frequency-domain coding mode.

Once the computation of the time-domain excitation contribution is completed, its efficiency needs to be assessed and quantized. If the gain of the coding in time-domain is very low, it is more efficient to remove the time-domain excitation contribution altogether and to use all the bits for the frequency-domain coding mode instead. On the other hand, for example in the case of a clean input speech, the frequency-domain coding mode is not needed and all the bits are allocated to the time-domain coding mode. But often the coding in time-domain is efficient only up to a certain frequency. This frequency will be called the cut-off frequency of the time-domain excitation contribution. Determination of such cut-off frequency ensures that the entire time-domain coding is helping to get a better final synthesis rather than working against the frequency-domain coding.

The cut-off frequency is estimated in the frequency-domain. To compute the cut-off frequency, the spectrums of both the LP residual and the time-domain coded contribution are first split into a predefined number of frequency bands. The number of frequency bands and the number of frequency bins covered by each frequency band can vary from one implementation to another. For each of the frequency bands, a normalized correlation is computed between the frequency representation of the time-domain excitation contribution and the frequency representation of the LP residual, and the correlation is smoothed between adjacent frequency bands. The per-band correlations are lower limited to 0.5 and normalized between 0 and 1. The average correlation is then computed as the average of the correlations for all the frequency bands. For the purpose of a first estimation of the cut-off frequency, the average correlation is then scaled between 0 and half the sampling rate (half the sampling rate corresponding to the normalized correlation value of 1). The first estimation of the cut-off frequency is then found as the upper bound of the frequency band being closest to that value. In an example of implementation, sixteen (16) frequency bands at 12.8 kHz are defined for the correlation computation.

Taking advantage of the psychoacoustic property of the human ear, the reliability of the estimation of the cut-off frequency is improved by comparing the estimated position of the $8^{th}$ harmonic frequency of the pitch to the cut-off frequency estimated by the correlation computation. If this position is higher than the cut-off frequency estimated by the correlation computation, the cut-off frequency is modified to correspond to the position of the $8^{th}$ harmonic frequency of the pitch. The final value of the cut-off frequency is then quantized and transmitted. In an example of implementation, 3 or 4 bits are used for such quantization, giving 8 or 16 possible cut-off frequencies depending on the bit rate.

Once the cut-off frequency is known, frequency quantization of the frequency-domain excitation contribution is performed. First the difference between the frequency representation (frequency transform) of the input LP residual and the frequency representation (frequency transform) of the time-domain excitation contribution is determined. Then a new vector is created, consisting of this difference up to the cut-off frequency, and a smooth transition to the frequency representation of the input LP residual for the remaining spectrum. A frequency quantization is then applied to the whole new vector. In an example of implementation, the quantization consists in coding the sign and the position of dominant (most energetic) spectral pulses. The number of the pulses to be quantized per frequency hand is related to the bitrate available for the frequency-domain coding mode. If there are not enough bits available to cover all the frequency bands, the remaining bands are filled with noise only.

Frequency quantization of a frequency band using the quantization method described in the previous paragraph does not guarantee that all frequency bins within this band are quantized. This is especially true at low bitrates where the number of pulses quantized per frequency band is relatively low. To prevent the apparition of audible artifacts due to these non-quantized bins, some noise is added to fill these gaps. As at low bit rates the quantized pulses should dominate the spectrum rather than the inserted noise, the noise spectrum amplitude corresponds only to a fraction of the amplitude of the pulses. The amplitude of the added noise in the spectrum is higher when the bit budget available is low (allowing more noise) and lower when the bit budget available is high.

In the frequency-domain coding mode, gains are computed for each frequency band to match the energy of the non-quantized signal to the quantized signal. The gains are vector quantized and applied per band to the quantized signal. When the encoder changes its bit allocation from the time-domain only coding mode to the mixed time-domain/frequency-domain coding mode, the per band excitation spectrum energy of the time-domain only coding mode does not match the per band excitation spectrum energy of the mixed time-domain/frequency domain coding mode. This energy mismatch can create some switching artifacts especially at low bit rate. To reduce any audible degradation created by this bit reallocation, a long-term gain can be computed for each band and can be applied to correct the energy of each frequency band for a few frames after the switching from the time-domain coding mode to the mixed time-domain/frequency-domain coding mode.

After the completion of the frequency-domain coding mode, the total excitation is found by adding the frequency-domain excitation contribution to the frequency representation (frequency transform) of the time-domain excitation contribution and then the sum of the excitation contributions is transformed back to time-domain to form a total excitation. Finally, the synthesized signal is computed by filtering the total excitation through a LP synthesis filter. In one implementation, while the CELP coding memories are updated on a sub-frame basis using only the time-domain excitation contribution, the total excitation is used to update those memories at frame boundaries. In another possible implementation, the CELP coding memories are updated on a sub-frame basis and also at the frame boundaries using only the time-domain excitation contribution. This results in an embedded structure where the frequency-domain quantized signal constitutes an upper quantization layer independent of the core CELP layer. In this particular case, the fixed codebook is always used in order to update the adaptive codebook content. However, the frequency-domain coding mode can apply to the whole frame. This embedded approach works for bit rates around 12 kbps and higher.

1) Sound Type Classification

Figure 2:
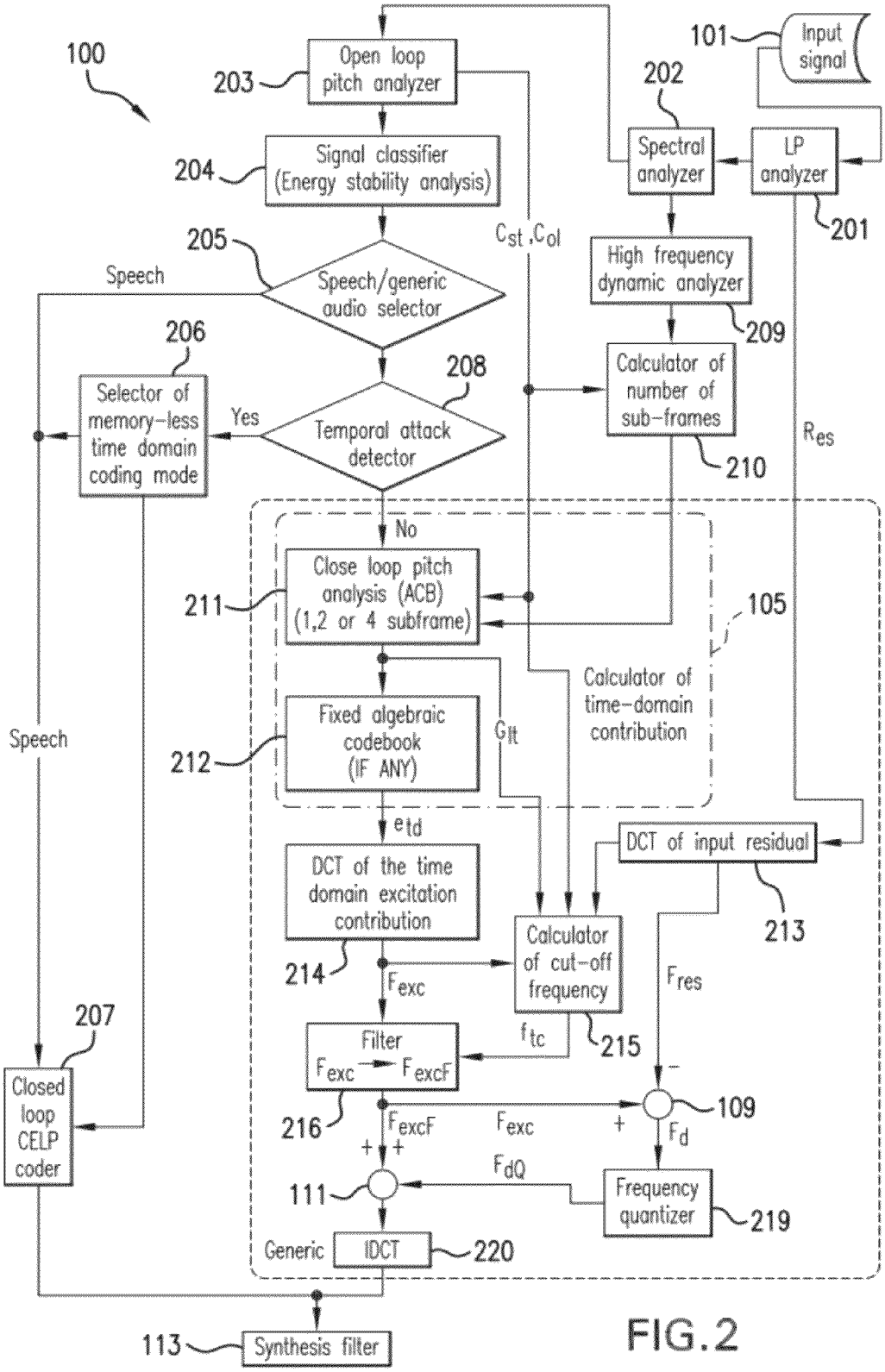
FIG. 2 is a schematic block diagram of a more detailed structure of the enhanced CELP encoder of FIG. 1.

FIG. 1 is a schematic block diagram illustrating an overview of an enhanced CELP encoder 100, for example an ACELP encoder. Of course, other types of enhanced CELP encoders can be implemented using the same concept. FIG. 2 is a schematic block diagram of a more detailed structure of the enhanced CELP encoder 100.

The CELP encoder 100 comprises a pre-processor 102 (FIG. 1) for analyzing parameters of the input sound signal 101 (FIGS. 1 and 2). Referring to FIG. 2, the pre-processor 102 comprises an LP analyzer 201 of the input sound signal 101, a spectral analyzer 202, an open loop pitch analyzer 203, and a signal classifier 204. The analyzers 201 and 202 perform the LP and spectral analyses usually carried out in CELP coding, as described for example in ITU-T recommendation G.718, sections 6.4 and 6.1.4, and, therefore, will not be further described in the present disclosure.

The pre-processor 102 conducts a first level of analysis to classify the input sound signal 101 between speech and non-speech (generic audio (music or reverberant speech)), for example in a manner similar to that described in reference [T. Vaillancourt et al., "Inter-tone noise reduction in a low bit rate CELP decoder," *Proc. IEEE ICASSP*, Taipei, Taiwan, April 2009, pp. 4113-16], of which the full content is incorporated herein by reference, or with any other reliable speech/non-speech discrimination methods.

After this first level of analysis, the pre-processor 102 performs a second level of analysis of input signal parameters to allow the use of time-domain CELP coding (no frequency-domain coding) on some sound signals with strong non-speech characteristics, but that are still better encoded with a time-domain approach. When an important variation of energy occurs, this second level of analysis allows the CELP encoder 100 to switch into a memory-less time-domain coding mode, generally called Transition Mode in reference [Eksler, V., and Jelínek, M. (2008), "Transition mode coding for source controlled CELP codecs", *IEEE Proceedings of International Conference on Acoustics, Speech and Signal Processing*, March-April, pp. 4001-40043], of which the full content is incorporated herein by reference.

During this second level of analysis, the signal classifier 204 calculates and uses a variation $\sigma_C$ of a smoothed version $C_{st}$ of the open-loop pitch correlation from the open-loop pitch analyzer 203, a current total frame energy $E_{tot}$ and a difference between the current total frame energy and the previous total frame energy $E_{diff}$. First the variation of the smoothed open loop pitch correlation is computed as:

$$\sigma_c = \sqrt{\sum_{i=0}^{i=-10} \left( \frac{(C_{st}(i) - \overline{C_{st}})^2}{10} \right)}$$

where:

the summation is between i=0 and i=−10;

$C_{st}$ is the smoothed open-loop pitch correlation defined as: $C_{st}=0.9 \cdot C_{ol}+0.1 \cdot C_{st}$;

$C_{ol}$ is the open-loop pitch correlation calculated by the analyzer 203 using a method known to those of ordinary skill in the art of CELP coding, for example, as described in ITU-T recommendation G.718, Section 6.6;

$\overline{C_{st}}$ is the average over the last 10 frames of the smoothed open-loop pitch correlation $C_{st}$;

$\sigma_C$ is the variation of the smoothed open loop pitch correlation.

When, during the first level of analysis, the signal classifier 204 classifies a frame as non-speech, the following verifications are performed by the signal classifier 204 to determine, in the second level of analysis, if it is really safe to use a mixed time-domain/frequency-domain coding mode. Sometimes, it is however better to encode the current frame with the time-domain coding mode only, using one of the time-domain approaches estimated by the pre-processing function of the time-domain coding mode. In particular, it might be better to use the memory-less time-domain coding mode to reduce at a minimum any possible pre-echo that can be introduced with a mixed time-domain/frequency-domain coding mode.

As a first verification whether the mixed time-domain/frequency-domain coding should be used, the signal classifier 204 calculates a difference between the current total frame energy and the previous frame total energy. When the difference $E_{diff}$ between the current total frame energy $E_{tot}$ and the previous frame total energy is higher than 6 dB, this corresponds to a so-called "temporal attack" in the input sound signal. In such a situation, the speech/non-speech decision and the coding mode selected are overwritten and a memory-less time-domain coding mode is forced. More specifically, the enhanced CELP encoder 100 comprises a time-only/time-frequency coding selector 103 (FIG. 1) itself comprising a speech/generic audio selector 205 (FIG. 2), a temporal attack detector 208 (FIG. 2), and a selector 206 of memory-less time-domain coding mode. In other words, in response to a determination of non-speech signal (generic audio) by the selector 205 and detection of a temporal attack in the input sound signal by the detector 208, the selector 206 forces a closed-loop CELP coder 207 (FIG. 2) to use the memory-less time-domain coding mode. The closed-loop CELP coder 207 forms part of the time-domain-only coder 104 of FIG. 1.

As a second verification, when the difference $E_{diff}$ between the current total frame energy $E_{tot}$ and the previous frame total energy is below or equal to 6 dB, but:

- the smoothed open loop pitch correlation $C_{st}$ is higher than 0.96; or
- the smoothed open loop pitch correlation $C_{st}$ is higher than 0.85 and the difference $E_{diff}$ between the current total frame energy $E_{tot}$ and the previous frame total energy is below 0.3 dB; or
- the variation of the smoothed open loop pitch correlation $\sigma_C$ is below 0.1 and the difference $E_{diff}$ between the current total frame energy $E_{tot}$ and the last previous frame total energy is below 0.6 dB; or
- the current total frame energy $E_{tot}$ is below 20 dB;

and this is at least the second consecutive frame (cnt≥2) where the decision of the first level of the analysis is going to be changed, then the speech/generic audio selector 205 determines that the current frame will be coded using a time-domain only mode using the closed-loop generic CELP coder 207 (FIG. 2).

Otherwise, the time/time-frequency coding selector 103 selects a mixed time-domain/frequency-domain coding mode that is performed by a mixed time-domain/frequency-domain coding device disclosed in the following description.

This can be summarized, for example when the non-speech sound signal is music, with the following pseudo code:

```
if (generic audio)
    if (E_diff > 6 dB)
        coding mode = Time domain memory less
        cnt = 1
    else if (C_st > 0.96 | (C_st > 0.85 & E_diff < 0.3 dB)|
    (σ_c < 0.1 & E_diff < 0.6 dB)|E_tot < 20 dB)
        cnt ++
        if (cnt >= 2)
            coding mode = Time domain
    else
        coding mode = mix time/frequency domain
        cnt = 0
```

Where $E_{tot}$ is a current frame energy expressed as:

$$E_{tot} = 10\log\left( \frac{\sum_{i=0}^{i=N} x(i)^2}{N} \right)$$

(where x(i) represents the samples of the input sound signal in the frame) and $E_{diff}$ is the difference between the current total frame energy $E_{tot}$ and the last previous frame total energy.

2) Decision on Sub-Frame Length

In typical CELP, input sound signal samples are processed in frames of 10-30 ms and these frames are divided into several sub-frames for adaptive codebook and fixed codebook analysis. For example, a frame of 20 ms (256 samples when the inner sampling frequency is 12.8 kHz) can be used and divided into 4 sub-frames of 5 ms. A variable sub-frame length is a feature used to obtain complete integration of the time-domain and frequency-domain into one coding mode. The sub-frame length can vary from a typical ¼ of the frame length to a half frame or a complete frame length. Of course the use of another number of sub-frames (sub-frame length) can be implemented.

The decision as to the length of the sub-frames (the number of sub-frames), or the time support, is determined by a calculator of the number of sub-frames 210 based on the available bitrate and on the input signal analysis in the pre-processor 102, in particular the high frequency spectral dynamic of the input sound signal 101 from an analyzer 209 and the open-loop pitch analysis including the smoothed open loop pitch correlation from analyzer 203. The analyzer 209 is responsive to the information from the spectral analyzer 202 to determine the high frequency spectral dynamic of the input signal 101. The spectral dynamic is computed from a feature described in the recommendation G.718, section 6.7.2.2, as the input spectrum without its noise floor giving a representation of the input spectrum dynamic. When the average spectral dynamic of the input sound signal 101 in the frequency band between 4.4 kHz and 64 kHz as determined by the analyzer 209 is below 9.6 dB and the last frame was considered as having a high spectral dynamic, the input signal 101 is no longer considered as having high spectral dynamic content in higher frequencies. In that case, more bits can be allocated to the frequencies below, for example, 4 kHz, by adding more sub-frames to the time-domain coding mode or by forcing more pulses in the lower frequency part of the frequency-domain contribution.

On the other hand, if the increase of the average dynamic of the higher frequency content of the input signal 101 against the average spectral dynamic of the last frame that was not considered as having a high spectral dynamic as determined by the analyser 209 is greater than, for example, 4.5 dB, the sound input signal 101 is considered as having high spectral dynamic content above, for example, 4 kHz. In that case, depending on the available bit rate, some additional bits are used for coding the high frequencies of the input sound signal 101 to allow one or more frequency pulses encoding.

The sub-frame length as determined by the calculator 210 (FIG. 2) is also dependent on the bit budget available. At very low bit rate, e.g. bit rates below 9 kbps, only one sub-frame is available for the time-domain coding otherwise the number of available bits will be insufficient for the frequency-domain coding. For medium bit rates, e.g. bit rates between 9 kbps and 16 kbps, one sub-frame is used for the case where the high frequencies contain high dynamic spectral content and two sub-frames if not. For medium-high bit rates, e.g. bit rates around 16 kbps and higher, the four (4) sub-frames case becomes also available if the smoothed open loop pitch correlation $C_{st}$, as defined in paragraph [0037] of sound type classification section, is higher than 0.8.

While the case with one or two sub-frames limits the time-domain coding to an adaptive codebook contribution only (with coded pitch lag and pitch gain), i.e. no fixed codebook is used in that case, the four (4) sub-frames allow for adaptive and fixed codebook contributions if the available bit budget is sufficient. The four (4) sub-frame case is allowed starting from around 16 kbps up. Because of bit budget limitations, the time-domain excitation consists only of the adaptive codebook contribution at lower bitrates. Simple fixed codebook contribution can be added for higher bit rates, for example starting at 24 kbps. For all cases the time-domain coding efficiency will be evaluated afterward to decide up to which frequency such time-domain coding is valuable.

3) Closed Loop Pitch Analysis

When a mixed time-domain/frequency-domain coding mode is used, a closed loop pitch analysis followed, if needed, by a fixed algebraic codebook search are performed. For that purpose, the CELP encoder 100 (FIG. 1) comprises a calculator of time-domain excitation contribution 105 (FIGS. 1 and 2). This calculator further comprises an analyzer 211 (FIG. 2) responsive to the open-loop pitch analysis conducted in the open-loop pitch analyzer 203 and the sub-frame length (or the number of sub-frames in a frame) determination in calculator 210 to perform a closed-loop pitch analysis. The closed-loop pitch analysis is well known to those of ordinary skill in the art and an example of implementation is described for example in reference [ITU-T G.718 recommendation; Section 6.8.4.1.4.1], the full content thereof being incorporated herein by reference. The closed-loop pitch analysis results in computing the pitch parameters, also known as adaptive codebook parameters, which mainly consist of a pitch lag (adaptive codebook index T) and pitch gain (or adaptive codebook gain b). The adaptive codebook contribution is usually the past excitation at delay T or an interpolated version thereof. The adaptive codebook index T is encoded and transmitted to a distant decoder. The pitch gain b is also quantized and transmitted to the distant decoder.

When the closed loop pitch analysis has been completed, the CELP encoder 100 comprises a fixed codebook 212 searched to find the best fixed codebook parameters usually comprising a fixed codebook index and a fixed codebook gain. The fixed codebook index and gain form the fixed codebook contribution. The fixed codebook index is encoded and transmitted to the distant decoder. The fixed codebook gain is also quantized and transmitted to the distant decoder. The fixed algebraic codebook and searching thereof is believed to be well known to those of ordinary skill in the art of CELP coding and, therefore, will not be further described in the present disclosure.

The adaptive codebook index and gain and the fixed codebook index and gain form a time-domain CELP excitation contribution.

4) Frequency Transform of Signal of Interest

During the frequency-domain coding of the mixed time-domain/frequency-domain coding mode, two signals need to be represented in a transform-domain, for example in frequency domain. In one implementation, the time-to-frequency transform can be achieved using a 256 points type II (or type IV) DCT (Discrete Cosine Transform) giving a resolution of 25 Hz with an inner sampling frequency of 12.8 kHz but any other transform could be used. In the case another transform is used, the frequency resolution (defined above), the number of frequency bands and the number of frequency bins per bands (defined further below) might need to be revised accordingly. In this respect, the CELP encoder 100 comprises a calculator 107 (FIG. 1) of a frequency-domain excitation contribution in response to the input LP residual $r_{es}(n)$ resulting from the LP analysis of the input sound signal by the analyzer 201. As illustrated in FIG. 2, the calculator 107 may calculate a DCT 213, for example a type II DCT of the input IP residual $r_{es}(n)$. The CELP encoder 100 also comprises a calculator 106 (FIG. 1) of a frequency transform of the time-domain excitation contribution. As illustrated in FIG. 2, the calculator 106 may calculate a DCT 214, for example a type II DCT of the time-domain excitation contribution. The frequency transform of the input LP residual $f_{res}$ and the time-domain CELP excitation contribution $f_{exc}$ can be calculated using the following expressions:

$$f_{res}(k) = \begin{cases} \sqrt{\frac{1}{N}} \cdot \sum_{n=0}^{N-1} r_{es}(n) \cdot \cos\left(\frac{\pi}{N}\left(n+\frac{1}{2}\right)k\right), & k = 0 \\ \sqrt{\frac{2}{N}} \cdot \sum_{n=0}^{N-1} r_{es}(n) \cdot \cos\left(\frac{\pi}{N}\left(n+\frac{1}{2}\right)k\right), & 1 \le k < N-1 \end{cases}$$

and:

$$f_{exc}(k) = \begin{cases} \sqrt{\frac{1}{N}} \cdot \sum_{n=0}^{N-1} e_{td}(n) \cdot \cos\left(\frac{\pi}{N}\left(n+\frac{1}{2}\right)k\right), & k = 0 \\ \sqrt{\frac{2}{N}} \cdot \sum_{n=0}^{N-1} e_{td}(n) \cdot \cos\left(\frac{\pi}{N}\left(n+\frac{1}{2}\right)k\right), & 1 \le k < N-1. \end{cases}$$

where $r_{es}(n)$ is the input LP residual, $e_{td}(n)$ is the time-domain excitation contribution, and N is the frame length. In a possible implementation, the frame length is 256 samples for a corresponding inner sampling frequency of 12.8 kHz. The time-domain excitation contribution is given by the following relation:

$$e_{td}(n)=bv(n)+gc(n)$$

where v(n) is the adaptive codebook contribution, b is the adaptive codebook gain, c(n) is the fixed codebook contribution, and g is the fixed codebook gain. It should be noted that the time-domain excitation contribution may consist only of the adaptive codebook contribution as described in the foregoing description.

5) Cut-Off Frequency of Time-Domain Contribution

With generic audio samples, the time-domain excitation contribution (the combination of adaptive and/or fixed algebraic codebooks) does not always contribute much to the coding improvement compared to the frequency-domain coding. Often, it does improve coding of the lower part of the spectrum while the coding improvement in the higher part of the spectrum is minimal. The CELP encoder 100 comprises a finder of a cut-off frequency and filter 108 (FIG. 1) that is the frequency where coding improvement afforded by the time-domain excitation contribution becomes too low to be valuable. The finder and filter 108 comprises a calculator of cut-off frequency 215 and the filter 216 of FIG. 2. The cut-off frequency of the time-domain excitation contribution is first estimated by the calculator 215 (FIG. 2) using a computer 303 (FIGS. 3 and 4) of normalized cross-correlation for each frequency band between the frequency-transformed input LP residual from calculator 107 and the frequency-transformed time-domain excitation contribution from calculator 106, respectively designated $f_{res}$ and $f_{exc}$ which are defined in the foregoing section 4. The last frequency $L_f$ included in each of, for example, the sixteen (16) frequency bands are defined in Hz as:

$$L_f = \{175, 375, 775, 1175, 1575, 1975, 2375, 2775, 3175, 3575, 3975, 4375, 4775, 5175, 5575, 6375\}$$

For this illustrative example, the number of frequency bins per band $B_b$, the cumulative frequency bins per band $C_{Bb}$, and the normalized cross-correlation per frequency band $C_c(i)$ are defined as follows, for a 20 ms frame at 12.8 kHz sampling frequency:

$$B_b = \{8, 8, 16, 16, 16, 16, 16, 16, 16, 16, 16, 16, 16, 16, 16, 32\}$$

$$C_{Bb} = \{0, 8, 16, 32, 48, 64, 80, 96, 112, 128, 144, 160, 176, 192, 208, 224\}$$

$$C_c(i) = \frac{\sum_{j=C_{Bb}(i)}^{j=C_{Bb}(i)+B_b(i)} f_{exc}(j) \cdot f_{res}(j)}{\sqrt{(S'_{f_{exc}}(i) \cdot S'_{f_{res}}(i))}}$$

Where $$S'_{f_{exc}}(i) = \sum_{j=C_{Bb}(i)}^{j=C_{Bb}(i)+B_b(i)} f_{exc}(j)^2$$

and $$S'_{f_{res}}(i) = \sum_{j=C_{Bb}(i)}^{j=C_{Bb}(i)+B_b(i)} f_{res}(j)^2$$

where $B_b$ is the number of frequency bins per band $B_b$, $C_{Bb}$ is the cumulative frequency bins per bands, $C_{Bb}C_c(i)$ is the normalized cross-correlation per frequency band, $S'_{f_{exc}}$ is the excitation energy for a band and similarly $S'_{f_{res}}$ is the residual energy per band.

The calculator of cut-off frequency 215 comprises a smoother 304 (FIGS. 3 and 4) of cross-correlation through the frequency bands performing some operations to smooth the cross-correlation vector between the different frequency bands. More specifically, the smoother 304 of cross-correlation through the bands computes a new cross-correlation vector $C_{c_s}$ using the following relation:

$$C_{c_2}(i) = \begin{cases} 2 \cdot (\min(0.5, \alpha \cdot C_c(0) + \delta C_c(1)) - 0.5) & \text{for } i = 0 \\ 2 \cdot (\min(0.5, \alpha \cdot C_c(i) + \beta C_c(i+1) + \beta C_c(i-1)) - 0.5) & \text{for } 1 \le i < N_b \end{cases}$$

where $$\alpha = 0.95; \quad \delta = (1 - \alpha); \quad N_b = 13; \quad \beta = \frac{\delta}{2}$$

The calculator of cut-off frequency 215 further comprises a calculator 305 (FIGS. 3 and 4) of an average of the new cross-correlation vector $C_{c_2}$ over the first $N_b$ bands ($N_b$=13 representing 5575 Hz).

The calculator 215 of cut-off frequency also comprises a cut-off frequency module 306 (FIG. 3) including a limiter 406 (FIG. 4) of the cross-correlation, a normaliser 407 of the cross-correlation and a finder 408 of the frequency band where the cross-correlation is the lowest. More specifically, the limiter 406 limits the average of the cross-correlation vector to a minimum value of 0.5 and the normaliser 408 normalises the limited average of the cross-correlation vector between 0 and 1. The finder 408 obtains a first estimate of the cut-off frequency by finding the last frequency of a frequency band $L_f$ which minimizes the difference between the said last frequency of a frequency band $L_f$ and the normalized average $\overline{C_{c_2}}$ of the cross-correlation vector $C_{c_2}$ multiplied by the width F/2 of the spectrum of the input sound signal:

$$i_{min} = \min_{0 \le i < N_b} \left( L_f(i) - \overline{C_{c_2}} \cdot \left( \frac{F_s}{2} \right) \right) \text{ and } f_{tc_1} = L_f(i_{min})$$

where $$F_s = 12800 \text{ Hz and } \overline{C_{c_2}} = \frac{\sum_{i=0}^{i=N_b-1} (C_{c_2}(i))}{N_b}$$

$f_{tc_s}$ is the first estimate of the cut-off frequency.

At low bit rate, where the normalized average $\overline{C}_{c_1}$ is never really high, or to artificially increase the value of $f_{tc_1}$ to give a little more weight to the time domain contribution, it is possible to upscale the value of $\overline{C}_{c_2}$ a fix scaling factor, for example, at bit rate below 8 kbps, $f_{tc_1}$ is multiplied by 2 all the time in the example implementation.

The precision of the cut-off frequency may be increased by adding a following component to the computation. For that purpose, the calculator 215 of cut-off frequency comprises an extrapolator 410 (FIG. 4) of the $8^{th}$ harmonic computed from the minimum or lowest pitch lag value of the time-domain excitation contribution of all sub-frames, using the following relation:

$$h_{8th} = \frac{8 \cdot F_s}{\min_{0 \le i < N_{sub}} (T(i))}$$

where $F_s$=12800 Hz, $N_{sub}$ is the number of sub-frames and T(i) is the adaptive codebook index or pitch lag for sub-frame i.

The calculator 215 of cut-off frequency also comprises a finder 409 (FIG. 4) of the frequency band in which the $8^{th}$ harmonic $h_{8^{th}}$ is located. More specifically, for all $i<N_b$, the finder 409 searches for the highest frequency band for which the following inequality is still verified:

$$(h_{8^{th}} \geq L_f(i))$$

The index of that band will be called $i_{8^{th}}$ and it indicates the band where the $8^{th}$ harmonic is likely located.

The calculator 215 of cut-off frequency finally comprises a selector 411 (FIG. 4) of the final cut-off frequency $f_{tc}$. More specifically, the selector 411 retains the higher frequency between the first estimate $f_{tc1}$ of the cut-off frequency from finder 408 and the last frequency of the frequency band in which the $8^{th}$ harmonic is located ($L_f(i_{8^{th}})$), using the following relation:

$$f_{tc}=\max(L_f(i_{8^{th}}),f_{tc1})$$

Figure 3:
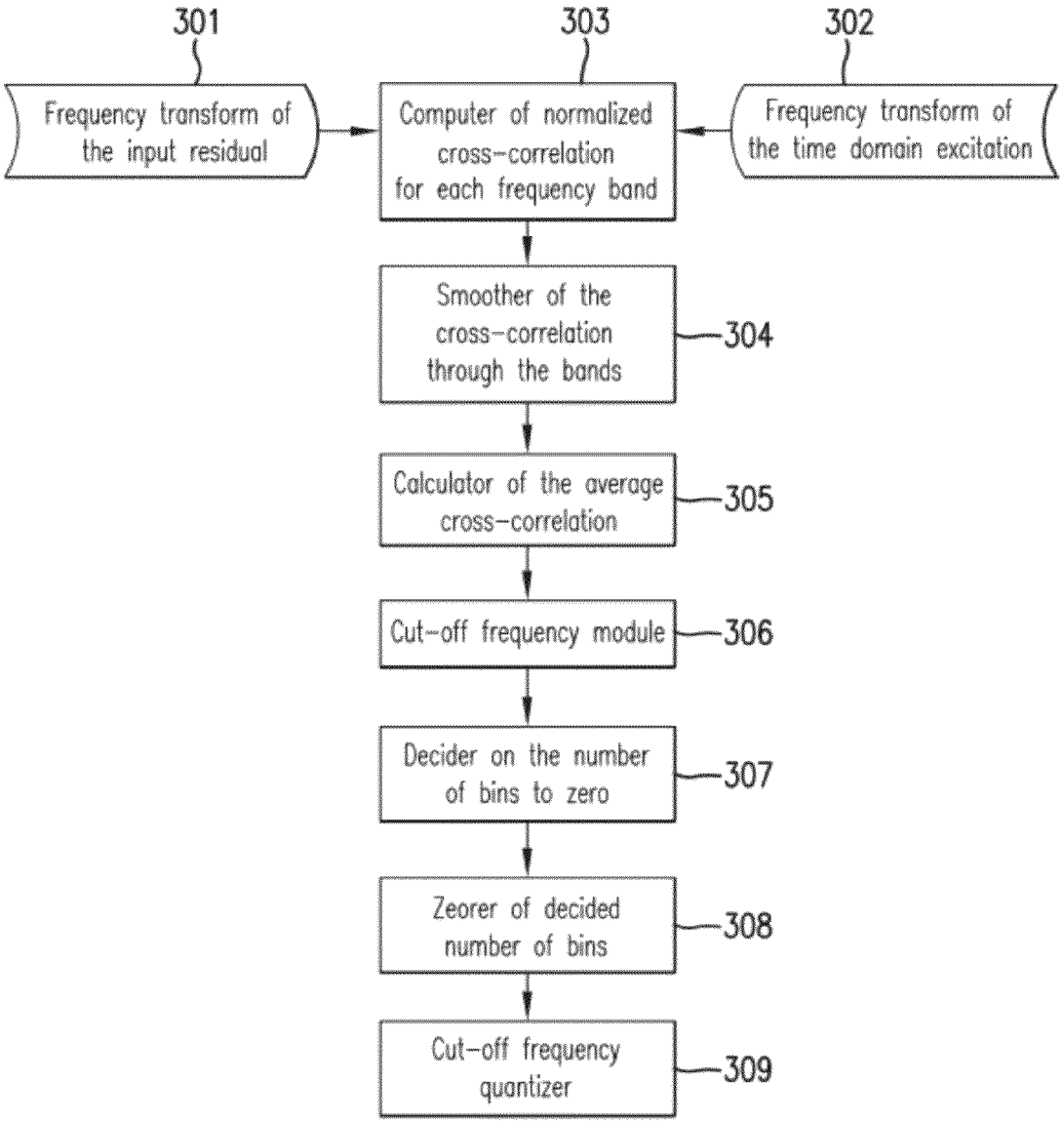
FIG. 3 is a schematic block diagram of an overview of a calculator of cut-off frequency.
Figure 4:
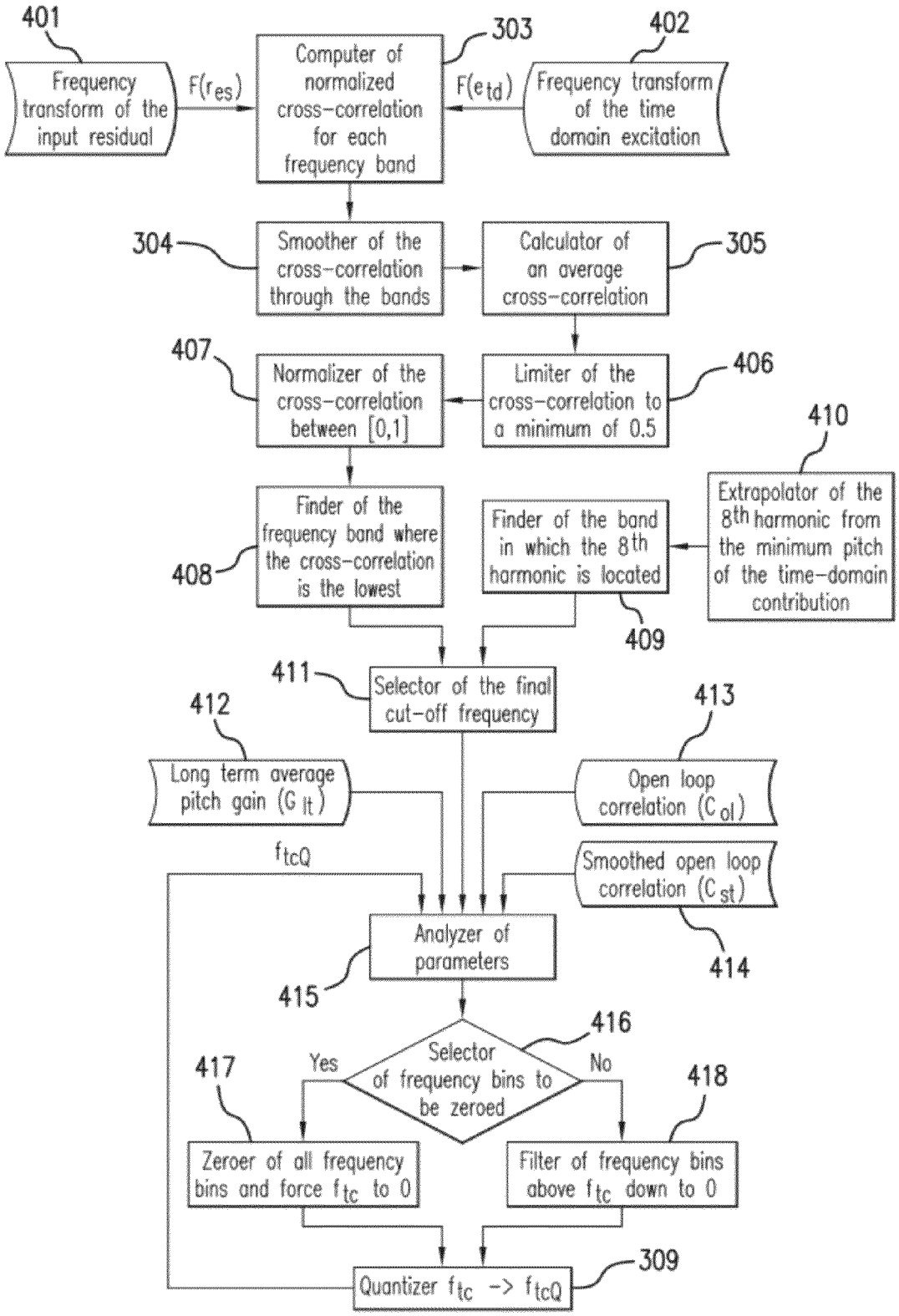
FIG. 4 is a schematic block diagram of a more detailed structure of the calculator of cut-off frequency of FIG. 3.

As illustrated in FIGS. 3 and 4, the calculator 215 of cut-off frequency further comprises a decider 307 (FIG. 3) on the number of frequency bins to be zeroed, itself including an analyser 415 (FIG. 4) of parameters, and a selector 416 (FIG. 4) of frequency bins to be zeroed; and the filter 216 (FIG. 2), operating in frequency domain, comprises a zeroer 308 (FIG. 3) of the frequency bins decided to be zeroed. The zeroer can zero out all the frequency bins (zeroer 417 in FIG. 4), or (filter 418 in FIG. 4) just some of the higher-frequency bins situated above the cut-off frequency $f_{tc}$ supplemented with a smooth transition region. The transition region is situated above the cut-off frequency $f_{tc}$ and below the zeroed bins, and it allows for a smooth spectral transition between the unchanged spectrum below $f_{tc}$ and the zeroed bins in higher frequencies.

For the illustrative example, when the cut-off frequency $f_{tc}$ from the selector 411 is below or equal to 775 Hz, the analyzer 415 considers that the cost of the time-domain excitation contribution is too high. The selector 416 selects all frequency bins of the frequency representation of the time-domain excitation contribution to be zeroed and the zeroer 417 forces to zero all the frequency bins and also force the cut-off frequency $f_{tc}$ to zero. All bits allocated to the time-domain excitation contribution are then reallocated to the frequency-domain coding mode. Otherwise, the analyzer 415 forces the selector 416 to choose the high frequency bins above the cut-off frequency $f_{tc}$ for being zeroed by the zeroer 418.

Finally, the calculator 215 of cut-off frequency comprises a quantizer 309 (FIGS. 3 and 4) of the cut-off frequency $f_{tc}$ into a quantized version $f_{tcQ}$ of this cut-off frequency. If three (3) bits are associated to the cut-off frequency parameter, a possible set of output values can be defined (in Hz) as follows:

$$f_{tcQ}—\{0,1175,1575,1975,2375,2775,3175,3575\}$$

Many mechanisms could be used to stabilize the choice of the final cut-off frequency $f_{tc}$ to prevent the quantized version $f_{tcQ}$ to switch between 0 and 1175 in inappropriate signal segment. To achieve this, the analyzer 415 in this example implementation is responsive to the long-term average pitch gain $G_{it}$ 412 from the closed loop pitch analyzer 211 (FIG. 2), the open-loop correlation $C_{ol}$ 413 from the open-loop pitch analyzer 203 and the smoothed open-loop correlation $C_{st}$. To prevent switching to a complete frequency coding, when the following conditions are met, the analyzer 415 does not allow the frequency-only coding, i.e. $f_{tcQ}$ cannot be set to 0:

$$f_{tc}>2375 \text{ Hz}$$

or $$f_{tc}>1175 \text{ Hz and } C_{ol}>0.7 \text{ and } G_{it}\geq 0.6$$

or $$f_{tc}\geq 1175 \text{ Hz and } C_{st}>0.8 \text{ and } G_{it}\geq 0.4$$

or $$f_{tcQ}(t-1)!=0 \text{ and } C_{ol}>0.5 \text{ and } C_{st}>0.5 \text{ and } G_{it}\geq 0.6$$

where $C_{ol}$ is the open-loop pitch correlation 413 and $C_{st}$ corresponds to the smoothed version of the open-loop pitch correlation 414 defined as $C_{st}=0.9\cdot C_{ol}+0.1\cdot C_{st}$. Further, $G_{it}$ (item 412 of FIG. 4) corresponds to the long term average of the pitch gain obtained by the closed loop-pitch analyzer 211 within the time-domain excitation contribution. The long term average of the pitch gain 412 is defined as $G_{it}=0.9\cdot \overline{G_p}+0.1\cdot G_{it}$ and $\overline{G_p}$ is the average pitch gain over the current frame. To further reduce the rate of switching between frequency-only coding and mixed time-domain/frequency-domain coding, a hangover can be added.

6) Frequency Domain Encoding

Creating a Difference Vector

Once the cut-off frequency of the time-domain excitation contribution is defined, the frequency-domain coding is performed. The CELP encoder 100 comprises a subtractor or calculator 109 (FIGS. 1, 2, 5 and 6) to form a first portion of a difference vector $f_d$ with the difference between the frequency transform $f_{res}$ 502 (FIGS. 5 and 6) (or other frequency representation) of the input LP residual from DCT 213 (FIG. 2) and the frequency transform $f_{exc}$ 501 (FIGS. 5 and 6) (or other frequency representation) of the time-domain excitation contribution from DCT 214 (FIG. 2) from zero up to the cut-off frequency $f_{tc}$ of the time-domain excitation contribution. A downscale factor 603 (FIG. 6) is applied to the frequency transform $f_{exc}$ 501 for the next transition region of $f_{trans}$=2 kHz (80 frequency bins in this example implementation) before its subtraction of the respective spectral portion of the frequency transform $f_{res}$. The result of the subtraction constitutes the second portion of the difference vector $f_d$ representing the frequency range from the cut-off frequency $f_{tc}$ up to $f_{tc}+f_{trans}$. The frequency transform $f_{res}$ 502 of the input LP residual is used for the remaining third portion of the vector $f_d$. The downscaled part of the vector $f_d$ resulting from application of the downscale factor 603 can be performed with any type of fade out function, it can be shortened to only few frequency bins, but it could also be omitted when the available bit budget is judged sufficient to prevent energy oscillation artifacts when the cut-off frequency $f_{tc}$ is changing. For example, with a 25 Hz resolution, corresponding to 1 frequency bin $f_{bin}$=25 Hz in 256 points DCT at 12.8 kHz, the difference vector can be built as:

$$f_d(k) = f_{res}(k) - f_{exc}(k)$$

$$\text{where } 0 \leq k \leq f_{tc} / f_{bin}$$

$$f_d(k) = f_{res}(k) - f_{exc}(k)\cdot\left(1 - \sin\left(\frac{\pi}{2}\cdot\frac{f_{bin}}{f_{trans}}\cdot\left(k - \frac{f_{tc}}{f_{bin}}\right)\right)\right)$$

$$\text{where } f_{tc} / f_{bin} < k \leq (f_{tc} + f_{trans}) / f_{bin}$$

$$f_d(k) = f_{res}(k), \text{ otherwise}$$

where $f_{res}$, $f_{exc}$ and $f_{tc}$ have been defined in previous sections 4 and 5.

Searching for Frequency Pulses

The CELP encoder 100 comprises a frequency quantizer 110 (FIGS. 1 and 2) of the difference vector $f_d$. The difference vector $f_d$ can be quantized using several methods. In all cases, frequency pulses have to be searched for and quantized. In one possible simple method, the frequency-domain coding comprises a search of the most energetic pulses of the difference vector $f_d$ across the spectrum. The method to search the pulses can be as simple as splitting the spectrum into frequency bands and allowing a certain number of pulses per frequency bands. The number of pulses per frequency bands depends on the bit budget available and on the position of the frequency band inside the spectrum. Typically, more pulses are allocated to the low frequencies.

Quantized Difference Vector

Depending on the bitrate available, the quantization of the frequency pulses can be performed using different techniques. In one implementation, at bitrate below 12 kbps, a simple search and quantization scheme can be used to code the position and sign of the pulses. This scheme is described herein below.

For example for frequencies lower than 3175 Hz, this simple search and quantization scheme uses an approach based on factorial pulse coding (FPC) which is described in the literature, for example in the reference [Mittal, U., Ashley, J. P., and Cruz-Zeno, E. M. (2007), "Low Complexity Factorial Pulse Coding of MDCT Coefficients using Approximation of Combinatorial Functions", *IEEE Proceedings on Acoustic, Speech and Signals Processing*, Vol, 1, April, pp. 289-292], the full content thereof being incorporated herein by reference.

Figure 5:
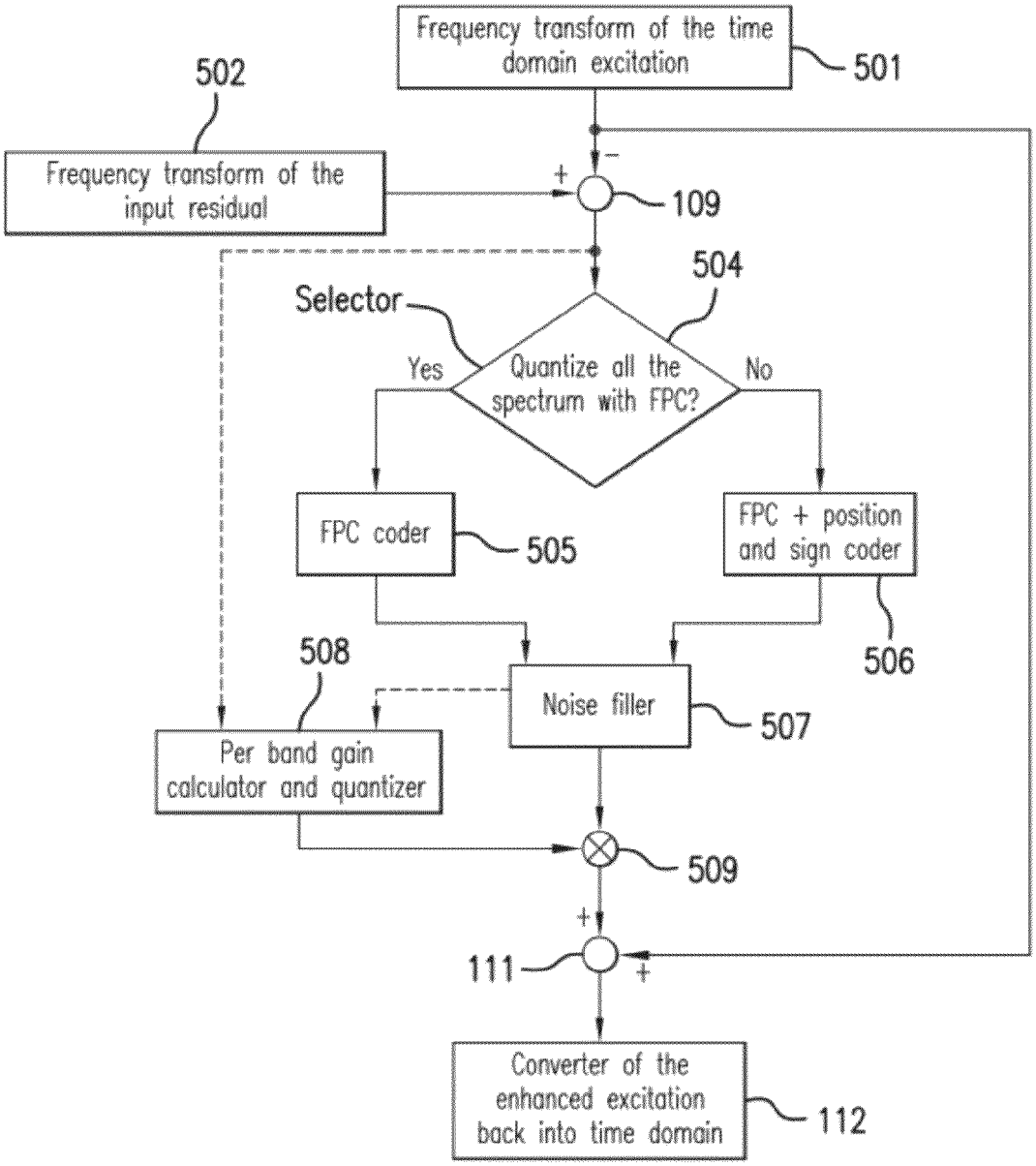
FIG. 5 is a schematic block diagram of an overview of a frequency quantizer.
Figure 6:
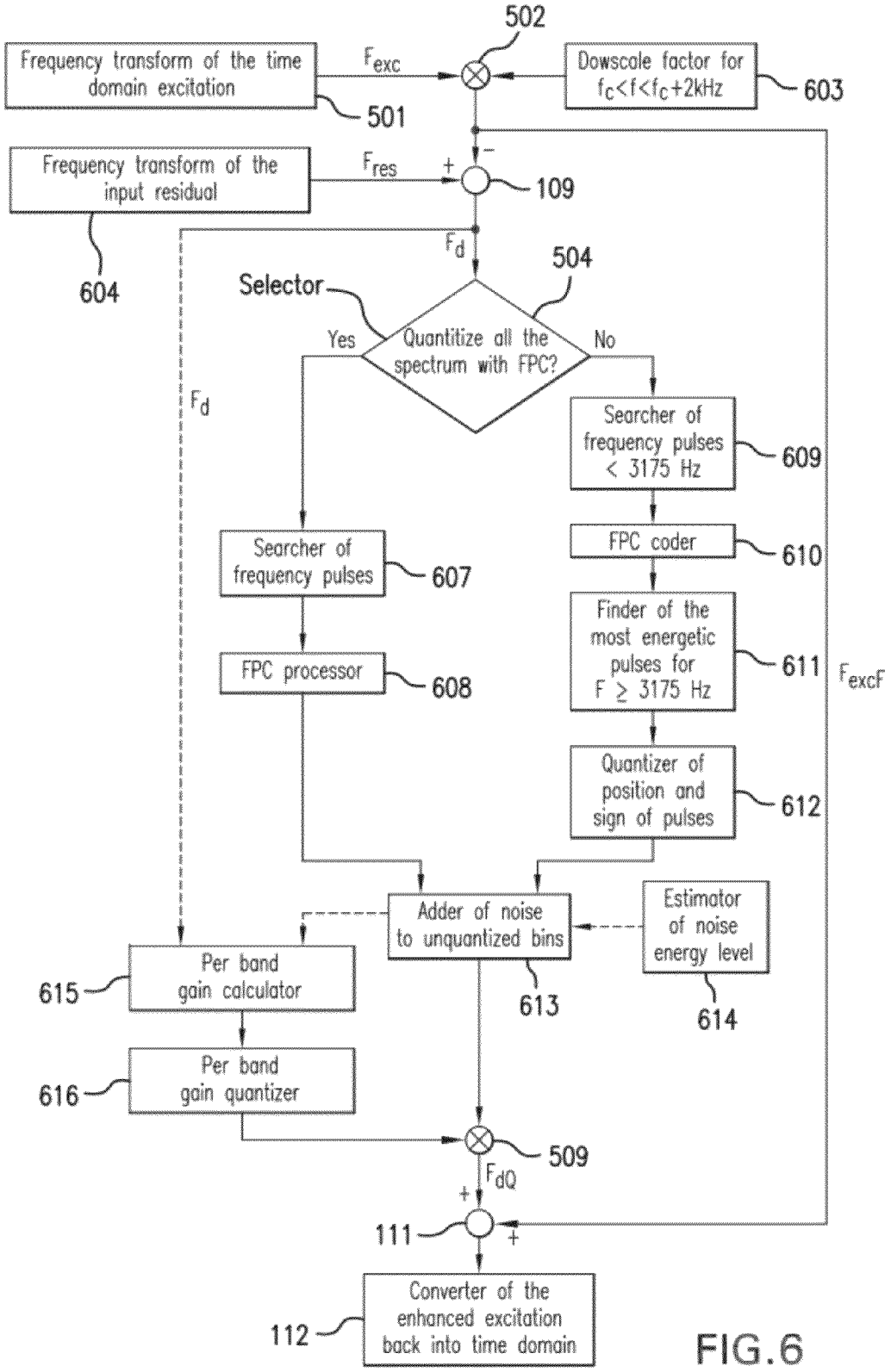
FIG. 6 is a schematic block diagram of a more detailed structure of the frequency quantizer of FIG. 5.

More specifically, a selector 504 (FIGS. 5 and 6) determines that all the spectrum is not quantized using FPC. As illustrated, in FIG. 5, FPC encoding and pulse position and sign coding is performed in a coder 506. As illustrated in FIG. 6, the coder 506 comprises a searcher 609 of frequency pulses. The search is conducted through all the frequency bands for the frequencies lower than 3175 Hz. An FPC coder 610 then processes the frequency pulses. The coder 506 also comprises a finder 611 of the most energetic pulses for frequencies equal to and larger than 3175 Hz, and a quantizer 612 of the position and sign of the found, most energetic pulses. If more than one (1) pulse is allowed within a frequency band then the amplitude of the pulse previously found is divided by 2 and the search is again conducted over the entire frequency band. Each time a pulse is found, its position and sign are stored for quantization and the bit packing stage. The following pseudo code illustrates this simple search and quantization scheme:

```
for k = 0: N_BD
  for i = 0: N_p
    p_max = 0
    for j = C_Bb(k): C_Bb(k) + B_b(k)
      if f_d(j)^2 > p_max
        p_max = f_d(j)^2
        f_d(j) = f_d(j)/2
        p_p(i) = j
        p_s(i) = sign(f_d(j))
      end
    end
  end
end
```

Where $N_{BD}$ is the number of frequency bands ($N_{BD}$=16 in the illustrative example), $N_p$ is the number of pulses to be coded in a frequency hand k, $B_b$ is the number of frequency bins per frequency band $B_b$, $C_{Bb}$ the cumulative frequency bins per band as defined previously in section 5, $p_p$ represents the vector containing the pulse position found, $p_s$ represents the vector containing the sign of the pulse found and $p_{max}$ represents the energy of the pulse found.

At bitrate above 12 kbps, the selector 504 determines that all the spectrum is to be quantized using FPC. As illustrated in FIG. 5, FPC encoding is performed in a coder 505. As illustrated in FIG. 6, the coder 505 comprises a searcher 607 of frequency pulses. The search is conducted through the entire frequency bands. A FPC processor 610 then FPC codes the found frequency pulses.

Then, the quantized difference vector $f_{dQ}$ is obtained by adding the number of pulses nb_pulses with the pulse sign $p_s$ to each of the position $p_p$ found. For each band the quantized difference vector $f_{dQ}$ can be written with the following pseudo code:

```
for j=0, . . . , j<nb_pulses
  f_dQ(p_p(j))+=p_s(j)
```

Noise Filling

All frequency bands are quantized with more or less precision; the quantization method described in the previous section does not guarantee that all frequency bins within the frequency bands are quantized. This is especially the case at low bitrates where the number of pulses quantized per frequency band is relatively low. To prevent the apparition of audible artifacts due to these unquantized bins, a noise filler 507 (FIG. 5) adds some noise to fill these gaps. This noise addition is performed over all the spectrum at bitrate below 12 kbps for example, but can be applied only above the cut-off frequency $f_{tc}$ of the time-domain excitation contribution for higher bitrates. For simplicity, the noise intensity varies only with the bitrate available. At high bit rates the noise level is low but the noise level is higher at low bit rates.

The noise filler 504 comprises an adder 613 (FIG. 6) which adds noise to the quantized difference vector $f_{dQ}$ after the intensity or energy level of such added noise has been determined in an estimator 614 and prior to the per band gain has been determined in a computer 615. In the illustrative embodiment, the noise level is directly related to the encoded bitrate. For example at 6.60 kbps the noise level $N'_L$ is 0.4 times the amplitude of the spectral pulses coded in a specific band and as it goes progressively down to a value of 0.2 times the amplitude of the spectral pulses coded in a band at 24 kbps. The noise is added only to section(s) of the spectrum where a certain number of consecutives frequency bins has a very low energy, for example when the number of consecutives very low energy bins $N_z$ is half the number of bins included in the frequency band. For a specific band i, the noise is injected as:

$$\text{for } j = C_{Bb}(i), \ldots, j < C_{Bb}(i) + B_b(i)$$

$$\text{if } \sum_{k=j}^{j+N_z} f_{dQ}(k)^2 < 0.5$$

$$\text{for } k = j, \ldots, k < j + N_z$$

$$f_{dQ}(k) = f_{dQ}(k) + N'_L(i) \cdot r_{and}()$$

$$j += N_z$$

$$\text{Where } N_z = \frac{B_b(i)}{2}$$

where, for a band i, $C_{Bb}$ is the cumulative number of bins per bands, $B_b$ is the number of bins in a specific band i, $N'_L$ is the noise level, and $r_{and}$ is a random number generator which is limited between −1 to 1.

7) Per Band Gain Quantization

The frequency quantizer 110 comprises a per band gain calculator/quantizer 508 (FIG. 5) including a calculator 615 (FIG. 6) of per band gain and a quantizer 616 (FIG. 6) of the calculated per band gain. Once the quantized difference vector $f_{dQ}$, including the noise fill if needed, is found, the calculator 615 computes the gain per band for each frequency band. The per band gain for a specific band $G_t(i)$ is defined as the ratio between the energy of the unquantized difference vector $f_d$ signal to the energy of the quantized difference vector $f_{dQ}$ in the log domain as:

$$G_b(i) = \log_{10}\left(\frac{S'_{fd}(i)}{S'_{fdQ}(i)}\right) \text{ Where}$$

$$S'_{fd}(i) = \sum_{i=C_{Bb}(i)}^{j=C_{Bb}(i)+B_b(i)} f_d(i)^2 \text{ and } S'_{fdQ}(i) = \sum_{i=C_{Bb}(i)}^{j=C_{Bb}(i)+B_b(i)} f_{dQ}(i)^2$$

where $C_{Bb}$ and $B_b$ are defined hereinabove in section 5.

In the implementation of FIGS. 5 and 6, the per band gain quantizer 616 vector quantizes the per band frequency gains. Prior to the vector quantization, at low bit rate, the last gain (corresponding to the last frequency band) is quantized separately, and all the remaining fifteen (15) gains are divided by the quantized last gain. Then, the normalized fifteen (15) remaining gains are vector quantized. At higher rate, the mean of the per band gains is quantized first and then removed from all per band gains of the, for example, sixteen (16) frequency bands prior the vector quantization of those per band gains. The vector quantization being used can be a standard minimization in the log domain of the distance between the vector containing the gains per band and the entries of a specific codebook.

In the frequency-domain coding mode, gains are computed in the calculator 615 for each frequency band to match the energy of the unquantized vector $f_d$ to the quantized vector $f_{dQ}$. The gains are vector quantized in quantizer 616 and applied per band to the quantized vector $f_{dQ}$ a multiplier 509 (FIGS. 5 and 6).

Alternatively, it is also possible to use the FPC coding scheme at rate below 12 kbps for the whole spectrum by selecting only some of the frequency bands to be quantized. Before performing the selection of the frequency bands, the energy $E_d$ of the frequency bands of the unquantized difference vector $f_d$, are quantized. The energy is computed as:

$$E_d(i) = \log_{10}(S_d(i))$$

$$\text{where } S_d(i) = \sum_{j=C_{Bb}(i)}^{j=C_{Bb}(i)+B_b(i)} f_d(j)^2$$

where $C_{Bb}$ and $B_b$ are defined hereinabove in section 5.

To perform the quantization of the frequency-band energy $E_d'$, first the average energy over the first 12 bands out of the sixteen bands used is quantized and subtracted from all the sixteen (16) band energies. Then all the frequency bands are vectors quantized per group of 3 or 4 bands. The vector quantization being used can be a standard minimization in the log domain of the distance between the vector containing the gains per band and the entries of a specific codebook. If not enough bits are available, it is possible to only quantize the first 12 bands and to extrapolate the last 4 bands using the average of the previous 3 bands or by any other methods.

Once the energy of frequency bands of the unquantized difference vector are quantized, it becomes possible to sort the energy in decreasing order in such a way that it would be replicable on the decoder side. During the sorting, all the energy bands below 2 kHz are always kept and then only the most energetic bands will be passed to the FPC for coding pulse amplitudes and signs. With this approach the FPC scheme codes a smaller vector but covering a wider frequency range. In others words, it takes less bits to cover important energy events over the entire spectrum.

After the pulse quantization process, a noise fill similar to what has been described earlier is needed. Then, a gain adjustment factor $G_a$ is computed per frequency band to match the energy $E_{dQ}$ of the quantized difference vector $f_{dQ}$ to the quantized energy $E_d'$ of the unquantized difference vector $f_d$. This per band gain adjustment factor is applied to the quantized difference vector $f_{dQ}$.

$$G_a(i) = 10^{E'_d(i)-E_{dQ}(i)} \text{ where}$$

$$E_{dQ}(i) = \log_{10}\left(\sum_{j=C_{Bb}(i)}^{j=C_{Bb}(i)+B_b(i)} f_{dQ}(j)^2\right)$$

and $E_d'$ is the quantized energy per band of the unquantized difference vector $f_d$ as defined earlier After the completion of the frequency-domain coding stage, the total time-domain/frequency domain excitation is found by summing through an adder 111 (FIGS. 1, 2, 5 and 6) the frequency quantized difference vector $f_{dQ}$ to the filtered frequency-transformed time-domain excitation contribution $f_{excF}$. When the enhanced CELP encoder 100 changes its bit allocation from a time-domain only coding mode to a mixed time-domain/frequency-domain coding mode, the excitation spectrum energy per frequency band of the time-domain only coding mode does not match the excitation spectrum energy per frequency band of the mixed time-domain/frequency domain coding mode. This energy mismatch can create switching artifacts that are more audible at low bit rate. To reduce any audible degradation created by this bit reallocation, a long-term gain can be computed for each band and can be applied to the summed excitation to correct the energy of each frequency band for a few frames after the reallocation. Then, the sum of the frequency quantized difference vector $f_{dQ}$ and the frequency-transformed and filtered time-domain excitation contribution $f_{excF}$ is then transformed back to time-domain in a converter 112 (FIGS. 1, 5 and 6) comprising for example an IDCT (Inverse DCT) 220.

Finally, the synthesized signal is computed by filtering the total excitation signal from the IDCT 220 through a LP synthesis filter 113 (FIGS. 1 and 2).

The sum of the frequency quantized difference vector $f_{dQ}$ and the frequency-transformed and filtered time-domain excitation contribution $f_{excF}$ forms the mixed time-domain/frequency-domain excitation transmitted to a distant decoder (not shown). The distant decoder will also comprise the converter 112 to transform the mixed time-domain/frequency-domain excitation back to time-domain using for example the IDCT (Inverse DCT) 220. Finally, the synthesized signal is computed in the decoder by filtering the total excitation signal from the IDCT 220, i.e. the mixed time-domain/frequency-domain excitation through the LP synthesis filter 113 (FIGS. 1 and 2).

In one implementation, while the CELP coding memories are updated on a sub-frame basis using only the time-domain excitation contribution, the total excitation is used to update those memories at frame boundaries. In another possible implementation, the CELP coding memories are updated on a sub-frame basis and also at the frame boundaries using only the time-domain excitation contribution. This results in an embedded structure where the frequency-domain quantized signal constitutes an upper quantization layer independent of the core CELP layer. This presents advantages in certain applications. In this particular case, the fixed codebook is always used to maintain good perceptual quality, and the number of sub-frames is always four (4) for the same reason. However, the frequency-domain analysis can apply to the whole frame. This embedded approach works for bit rates around 12 kbps and higher.

The foregoing disclosure relates to non-restrictive, illustrative implementations, and these implementations can be modified at will, within the scope of the appended claims.

The invention claimed is:

1. A mixed time-domain/frequency-domain coding device for coding an input sound signal, comprising:

a calculator of a time-domain excitation contribution in response to the input sound signal;

a calculator of a cut-off frequency for the time-domain excitation contribution in response to the input sound signal;

a filter responsive to the cut-off frequency for adjusting a frequency extent of the time-domain excitation contribution;

a calculator of a frequency-domain excitation contribution in response to the input sound signal; and an adder of the filtered time-domain excitation contribution and the frequency-domain excitation contribution to form a mixed time-domain/frequency-domain excitation constituting a coded version of the input sound signal.

2. A mixed time-domain/frequency-domain coding device according to claim 1, wherein the time-domain excitation contribution includes (a) only an adaptive codebook contribution, or (b) the adaptive codebook contribution and a fixed codebook contribution.

3. A mixed time-domain/frequency-domain coding device according to claim 2, wherein the calculator of time-domain excitation contribution uses a Code-Excited Linear Prediction coding of the input sound signal.

4. A mixed time-domain/frequency-domain coding device according to claim 3, wherein the calculator of frequency-domain excitation contribution comprises a calculator of a difference between a frequency representation an LP residual of the input sound signal and a filtered frequency representation of the time-domain excitation contribution.

5. A mixed time-domain/frequency-domain coding device according to claim 3, wherein the calculator of frequency-domain excitation contribution performs a frequency transform of a LP residual obtained from an LP analysis of the input sound signal to produce a frequency representation of the LP residual.

6. A mixed time-domain/frequency-domain coding device according to claim 5, wherein the calculator of cut-off frequency comprises a computer of cross-correlation, for each of a plurality of frequency bands, between the frequency representation of the LP residual and a frequency representation of the time-domain excitation contribution, and the coding device comprises a finder of an estimate of the cut-off frequency in response to the cross-correlation.

7. A mixed time-domain/frequency-domain coding device according to claim 5, comprising a smoother of the cross-correlation through the frequency bands to produce a cross-correlation vector, a calculator of an average of the cross-correlation vector over the frequency bands, and a normalizer of the average of the cross-correlation vector, wherein the finder of the estimate of the cut-off frequency determines a first estimate of the cut-off frequency by finding a last frequency of one of the frequency bands which minimizes a difference between said last frequency and the normalized average of the cross-correlation vector multiplied by a spectrum width value.

8. A mixed time-domain/frequency-domain coding device according to claim 7, wherein the calculator of cut-off frequency comprises a finder of one of the frequency bands in which a harmonic computed from the time-domain excitation contribution is located, and a selector of the cut-off frequency as the higher frequency between said first estimate of the cut off-frequency and a last frequency of the frequency band in which said harmonic is located.

9. A mixed time-domain/frequency-domain coding device according to claim 5, wherein the calculator of frequency-domain excitation contribution comprises a calculator of a difference between the frequency representation of the LP residual and a frequency representation of the time-domain excitation contribution up to the cut-off frequency to form a first portion of a difference vector.

10. A mixed time-domain/frequency-domain coding device according to claim 9, comprising a downscale factor applied to the frequency representation of the time-domain excitation contribution in a determined frequency range following the cut-off frequency to form a second portion of the difference vector.

11. A mixed time-domain/frequency-domain coding device according to claim 10, wherein the difference vector is formed by the frequency representation of the LP residual for a third remaining portion above the determined frequency range.

12. A mixed time-domain/frequency-domain coding device according to claim 9, comprising a quantizer of the difference vector.

13. A mixed time-domain/frequency-domain coding device according to claim 12, wherein the adder adds, in the frequency domain, the quantized difference vector and a frequency-transformed version of the filtered, time-domain excitation contribution to form the mixed time-domain/frequency-domain excitation.

14. A mixed time-domain/frequency-domain coding device according to claim 2, comprising a calculator of a number of sub-frames to be used in a current frame, wherein the calculator of time-domain excitation contribution uses in the current frame the number of sub-frames determined by the sub-frame number calculator for said current frame.

15. A mixed time-domain/frequency-domain coding device according to claim 14, wherein the calculator of the number of sub-frames in the current frame is responsive to at least one of an available bit budget and a high frequency spectral dynamic of the input sound signal.

16. A mixed time-domain/frequency-domain coding device according to claim 1, comprising a calculator of a frequency transform of the time-domain excitation contribution.

17. A decoder for decoding a sound signal coded using the mixed time-domain/frequency-domain coding device of claim 16, comprising:

a converter of the mixed time-domain/frequency-domain excitation in time-domain; and a synthesis filter for synthesizing the sound signal in response to the mixed time-domain/frequency-domain excitation converted in time-domain.

18. A decoder according to claim 17, wherein the converter uses an inverse discrete cosine transform.

19. A decoder according to claim 17, wherein the synthesis filter is a LP synthesis filter.

20. A mixed time-domain/frequency-domain coding device according to claim 1, wherein the filter comprises a zeroer of frequency bins which forces the frequency bins of a plurality of frequency bands above the cut-off frequency to zero.

21. A mixed time-domain/frequency-domain coding device according to claim 1, wherein the filter comprises a zeroer of frequency bins which forces all the frequency bins of a plurality of frequency bands to zero when the cut-off frequency is lower than a given value.

22. A mixed time-domain/frequency-domain coding device according to claim 1, wherein the adder adds the time-domain excitation contribution and the frequency-domain excitation contribution in the frequency domain.

23. A mixed, time-domain/frequency-domain coding device according to claim 1, comprising means for dynamically allocating a bit budget between the time-domain excitation contribution and the frequency-domain excitation contribution.

24. An encoder using a time-domain and frequency-domain model, comprising:

a classifier of an input sound signal as speech or non-speech;

a time-domain only coder;

the mixed time-domain/frequency-domain coding device of claim 1; and a selector of one of the time-domain only coder and the mixed time-domain/frequency-domain coding device for coding the input sound signal depending on the classification of the input sound signal.

25. An encoder as defined in claim 24, wherein the time-domain only coder is a Code-Excited Linear Prediction coder.

26. An encoder as defined in claim 24, comprising a selector of a memory-less time-domain coding mode which, when the classifier classifies the input sound signal as non-speech and detects a temporal attack in the input sound signal, forces the memory-less time-domain coding mode for coding the input sound signal in the time-domain only coder.

27. An encoder as defined in claim 24, wherein the mixed time-domain/frequency-domain coding device uses sub-frames of a variable length in the calculation of a time-domain contribution.

28. A mixed time-domain/frequency-domain coding device for coding an input sound signal, comprising:

a calculator of a time-domain excitation contribution in response to the input sound signal, wherein the calculator of time-domain excitation contribution processes the input sound signal in successive frames of said input sound signal and comprises a calculator of a number of sub-frames to be used in a current frame of the input sound signal, wherein the sub-frame number calculator is responsive to at least one of an available bit budget and a high frequency spectral dynamic of the input sound signal and wherein the calculator of time-domain excitation contribution uses in the current frame the number of sub-frames determined by the sub-frame number calculator for said current frame;

a calculator of a frequency-domain excitation contribution in response to the input sound signal; and an adder of the time-domain excitation contribution and the frequency-domain excitation contribution to form a mixed time-domain/frequency-domain excitation constituting a coded version of the input sound signal.

29. A decoder for decoding a sound signal coded using the mixed time-domain/frequency-domain coding device of claim 28, comprising:

a converter of the mixed time-domain/frequency-domain excitation in time-domain; and a synthesis filter for synthesizing the sound signal in response to the mixed time-domain/frequency-domain excitation converted in time-domain.

30. A mixed time-domain/frequency-domain coding method for coding an input sound signal, comprising:

calculating a time-domain excitation contribution in response to the input sound signal;

calculating a cut-off frequency for the time-domain excitation contribution in response to the input sound signal;

in response to the cut-off frequency, adjusting a frequency extent of the time-domain excitation contribution;

calculating a frequency-domain excitation contribution in response to the input sound signal; and adding the adjusted time-domain excitation contribution and the frequency-domain excitation contribution to form a mixed time-domain/frequency-domain excitation constituting a coded version of the input sound signal.

31. A mixed time-domain/frequency-domain coding method according to claim 30, wherein the time-domain excitation contribution includes (a) only an adaptive codebook contribution, or (b) the adaptive codebook contribution and a fixed codebook contribution.

32. A mixed time-domain/frequency-domain coding method according to claim 31, wherein calculating the time-domain excitation contribution comprises using a Code-Excited Linear Prediction coding of the input sound signal.

33. A mixed time-domain/frequency-domain coding method according to claim 32, wherein calculating the frequency-domain excitation contribution comprises calculating a difference between a frequency representation an LP residual of the input sound signal and a filtered frequency representation of the time-domain excitation contribution.

34. A mixed time-domain/frequency-domain coding method according to claim 32, wherein calculating the frequency-domain excitation contribution comprises performing a frequency transform of a LP residual obtained from an LP analysis of the input sound signal to produce a frequency representation of the LP residual.

35. A mixed time-domain/frequency-domain coding method according to claim 34, wherein calculating the cut-off frequency comprises computing a cross-correlation, for each of a plurality of frequency bands, between the frequency representation of the LP residual and a frequency representation of the time-domain excitation contribution, and the coding method comprises finding an estimate of the cut-off frequency in response to the cross-correlation.

36. A mixed time-domain/frequency-domain coding method according to claim 35, comprising smoothing the cross-correlation through the frequency bands to produce a cross-correlation vector, calculating an average of the cross-correlation vector over the frequency bands, and normalizing the average of the cross-correlation vector, wherein finding the estimate of the cut-off frequency comprises determining a first estimate of the cut-off frequency by finding a last frequency of one of the frequency bands which minimizes a difference between said last frequency and the normalized average of the cross-correlation vector multiplied by a spectrum width value.

37. A mixed time-domain/frequency-domain coding method according to claim 36, wherein calculating the cut-off frequency comprises finding one of the frequency bands in which a harmonic computed from the time-domain excitation contribution is located, and selecting the cut-off frequency as the higher frequency between said first estimate of the cut off-frequency and a last frequency of the frequency band in which said harmonic is located.

38. A mixed time-domain/frequency-domain coding method according to claim 34, wherein calculating the frequency-domain excitation contribution comprises calculating a difference between the frequency representation of the LP residual and a frequency representation of the time-domain excitation contribution up to the cut-off frequency to form a first portion of a difference vector.

39. A mixed time-domain/frequency-domain coding method according to claim 38, comprising applying a downscale factor to the frequency representation of the time-domain excitation contribution in a determined frequency range following the cut-off frequency to form a second portion of the difference vector.

40. A mixed time-domain/frequency-domain coding method according to claim 39, comprising forming the difference vector with the frequency representation of the LP residual for a third remaining portion above the determined frequency range.

41. A mixed time-domain/frequency-domain coding method according to claim 38, comprising quantizing the difference vector.

42. A mixed time-domain/frequency-domain coding method according to claim 41, wherein adding the adjusted time-domain excitation contribution and the frequency-domain excitation contribution to form the mixed time-domain/frequency-domain excitation comprises adding, in the frequency domain, the quantized difference vector and a frequency-transformed version of the adjusted, time-domain excitation contribution.

43. A mixed time-domain/frequency-domain coding method according to claim 31, comprising calculating a number of sub-frames to be used in a current frame, wherein calculating the time-domain excitation contribution comprises using in the current frame the number of sub-frames determined for said current frame.

44. A mixed time-domain/frequency-domain coding method according to claim 43, wherein calculating the number of sub-frames in the current frame is responsive to at least one of an available bit budget and a high frequency spectral dynamic of the input sound signal.

45. A mixed time-domain/frequency-domain coding method according to claim 30, comprising calculating a frequency transform of the time-domain excitation contribution.

46. A method of decoding a sound signal coded using the mixed time-domain/frequency-domain coding method of claim 45, comprising:

converting the mixed time-domain/frequency-domain excitation in time-domain; and synthesizing the sound signal through a synthesis filter in response to the mixed time-domain/frequency-domain excitation converted in time-domain.

47. A method of decoding according to claim 46, wherein converting the mixed time-domain/frequency-domain excitation in time-domain comprises using an inverse discrete cosine transform.

48. A method of decoding according to claim 46, wherein the synthesis filter is a LP synthesis filter.

49. A mixed time-domain/frequency-domain coding method according to claim 30, wherein adjusting the frequency extent of the time-domain excitation contribution comprises zeroing frequency bins to force the frequency bins of a plurality of frequency bands above the cut-off frequency to zero.

50. A mixed time-domain/frequency-domain coding method according to claim 30, wherein adjusting the frequency extent of the time-domain excitation contribution comprises zeroing frequency bins to force all the frequency bins of a plurality of frequency bands to zero when the cut-off frequency is lower than a given value.

51. A mixed time-domain/frequency-domain coding method according to claim 30, wherein adding the adjusted time-domain excitation contribution and the frequency-domain excitation contribution to form the mixed time-domain/frequency-domain excitation comprises adding the time-domain excitation contribution and the frequency-domain excitation contribution in the frequency domain.

52. A mixed, time-domain/frequency-domain coding method according to claim 30, comprising dynamically allocating a bit budget between the time-domain excitation contribution and the frequency-domain excitation contribution.

53. A method of encoding using a time-domain and frequency-domain model, comprising:

classifying an input sound signal as speech or non-speech;

providing a time-domain only coding method;

providing the mixed time-domain/frequency-domain coding method of claim 30; and selecting one of the time-domain only coding method and the mixed time-domain/frequency-domain coding method for coding the input sound signal depending on the classification of the input sound signal.

54. A method of encoding as defined in claim 53, wherein the time-domain only coding method is a Code-Excited Linear Prediction coding method.

55. A method of encoding as defined in claim 53, comprising selecting a memory-less time-domain coding mode which, when the input sound signal is classified as non-speech and a temporal attack in the input sound signal is detected, forces the memory-less time-domain coding mode for coding the input sound signal using the time-domain only coding method.

56. A method of encoding as defined in claim 53, wherein the mixed time-domain/frequency-domain coding method comprises using sub-frames of a variable length in the calculation of a time-domain contribution.

57. A mixed time-domain/frequency-domain coding method for coding an input sound signal, comprising:

calculating a time-domain excitation contribution in response to the input sound signal, wherein calculating the time-domain excitation contribution comprises processing the input sound signal in successive frames of said input sound signal and calculating a number of sub-frames to be used in a current frame of the input sound signal, wherein calculating the number of sub-frames in the current frame is responsive to at least one of an available bit budget and a high frequency spectral dynamic of the input sound signal and wherein calculating the time-domain excitation contribution also comprises using in the current frame the number of sub-frames calculated for said current frame;

calculating a frequency-domain excitation contribution in response to the input sound signal; and adding the time-domain excitation contribution and the frequency-domain excitation contribution to form a mixed time-domain/frequency-domain excitation constituting a coded version of the input sound signal.

58. A method of decoding a sound signal coded using the mixed time-domain/frequency-domain coding method of claim 57, comprising:

converting the mixed time-domain/frequency-domain excitation in time-domain; and synthesizing the sound signal through a synthesis filter in response to the mixed time-domain/frequency-domain excitation converted in time-domain.

* * * * *